United States Patent [19]

Dejoux et al.

[11] 4,437,359

[45] Mar. 20, 1984

[54] WINE WAITER'S CORKSCREWS

[76] Inventors: André Dejoux, 15, rue Lakanal, 75015 Paris; Bruno Desnoulez, 76 Boulevard Koenig, 92200 Neuilly, both of France

[21] Appl. No.: 267,454

[22] Filed: May 27, 1981

[30] Foreign Application Priority Data

May 23, 1980 [FR] France ..... 80 11499

[51] Int. Cl.[3] ..... B67B 7/04

[52] U.S. Cl. ..... 81/3.38 A; 7/154; 30/1.5; 81/3.1 A

[58] Field of Search ..... 81/3.38 A, 3.1 R, 3.1 A, 81/3.34, 3.36, 3.44; 30/1.5; 7/154, 155, 156

[56] References Cited

FOREIGN PATENT DOCUMENTS

| | | | |
|---|---|---|---|
| 515181 | 12/1971 | Switzerland | 81/3.34 |
| 1444878 | 8/1976 | United Kingdom | 81/3.1 R |
| 303283 | 5/1971 | U.S.S.R. | 81/3.46 |

*Primary Examiner*—E. R. Kazenske
*Assistant Examiner*—Douglas D. Watts
*Attorney, Agent, or Firm*—Browdy & Neimark

[57] ABSTRACT

A corkscrew is combined with a flat elongated handle. Two extraction levers are pivoted to one end of the handle. Each lever has a notch for resting on the bottle neck to help extract corks.

4 Claims, 12 Drawing Figures

FIG. 1
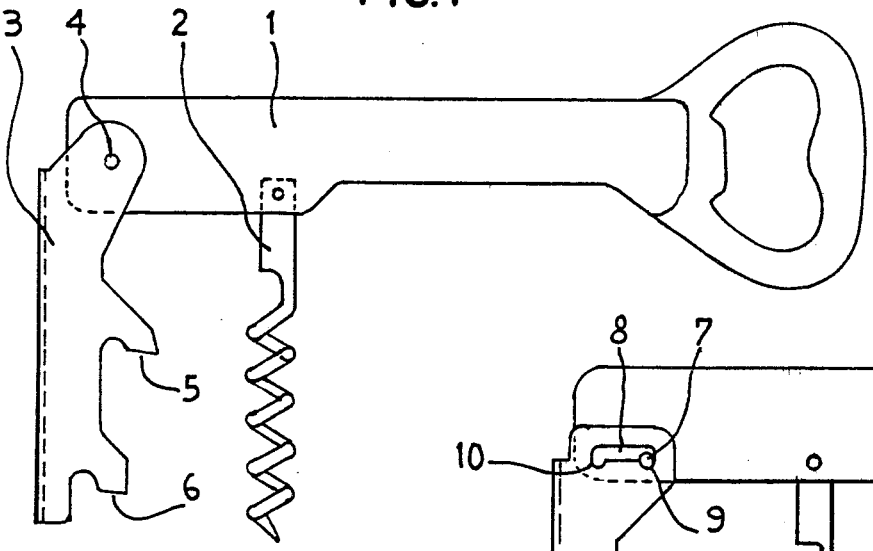
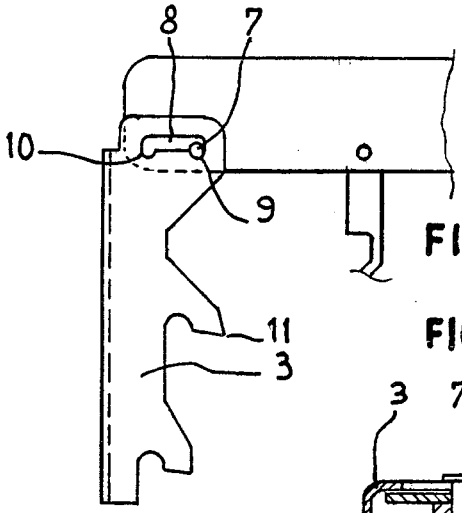
FIG. 2
FIG. 2a
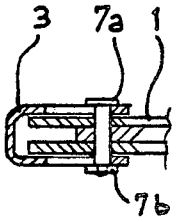
FIG. 3
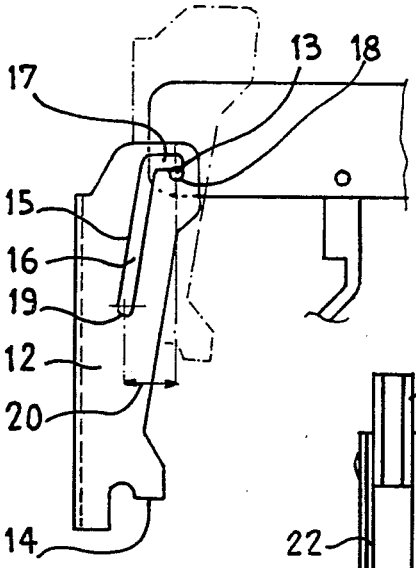
FIG. 4
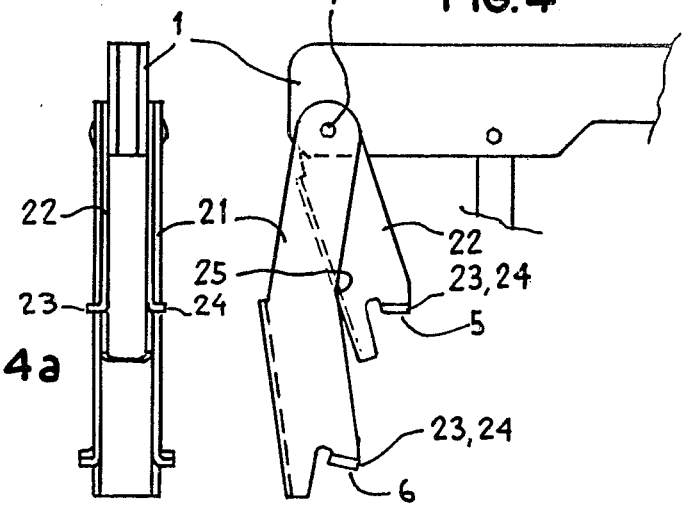
FIG. 4a

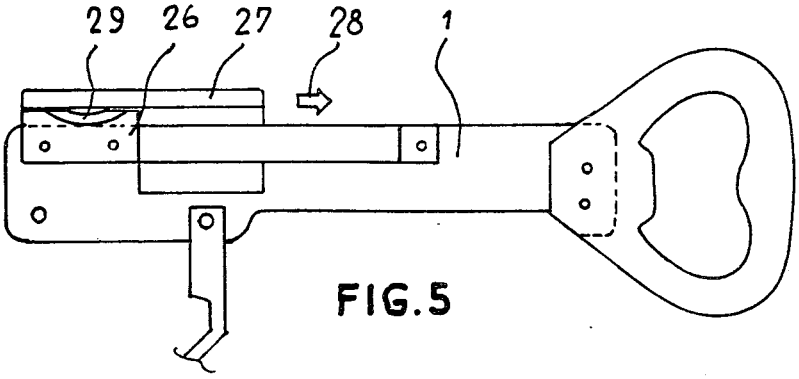
FIG. 5
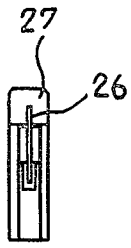
FIG. 6
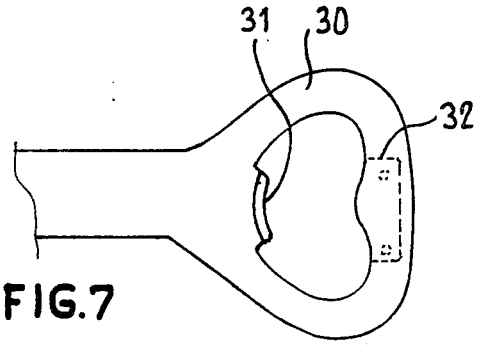
FIG. 7
FIG. 8
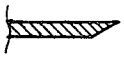
FIG. 10
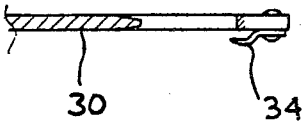
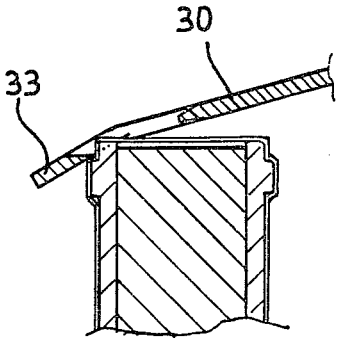
FIG. 9

WINE WAITER'S CORKSCREWS

FIELD OF THE INVENTION

The invention relates to a wine waiter's corkscrew.

BACKGROUND OF THE INVENTION

Wine waiter's corkscrews are well known. They generally comprise a flat handle, an auger screwing into the cork, an extraction lever resting on the rim of bottle neck and working with the handle to obtain a reduction of the extraction effort, and accessorily a bottle opener and an articulated, flexible cutting blade.

These corkscrews generally do not enable the cork to be extracted completely by the lever action. Almost always, a slight part of the cork remains engaged in the bottle neck, the final extraction of which is performed by a direct pull exerted in the axis of the neck.

SUMMARY OF THE INVENTION

The object of the invention is to solve the problem described above, by extracting the cork entirely from the bottle by means of a lever, thus reducing the extraction effort during the entire extraction period.

This object is obtained, according to the invention, by using extraction lever means comprising two notches for successive support on the bottle neck that are spaced from one another by such a value as to allow extraction of the cork in two steps.

The advantage brought by the invention lies in the fact that it makes possible the total extraction of even the longest corks by reduction of the effort for completion of cork extraction.

BRIEF DESCRIPTION OF THE DRAWINGS

Other characteristics and advantages are set forth in the text below with reference to the accompanying drawings in which:

FIG. 1 shows, in elevation, a corkscrew according to the invention,

FIGS. 2 and 2*a* show an example of the extraction lever articulated in two positions, FIG. 3 shows another variant of the corkscrew the extraction lever of which also comprises two articulation positions and only one notch, FIGS. 4 and 4*a* show another example of an embodiment in which the extraction lever is made in two parts, FIGS. 5 and 6 show an example of a cutting blade with its protective cover, FIGS. 7, 8, 9 and 10 show variations of other embodiments of the cutting blade provided on the bottle opener.

DETAILED DESCRIPTION OF PREFERRED EMBODIMENTS

As shown in FIG. 1, the corkscrew according to the invention comprises handle 1, auger 2 and extraction lever 3, which is articulated on pin 4. Lever 3 comprises, in contrast with corkscrews of this type, two notches 5 and 6. Notch 5 rests on the end of the bottle neck to perform the first extraction, then second notch 6 takes the place of the first notch and the second half of the extraction step is performed, thus reducing the effort for completion of the extraction.

FIG. 2 shows a variant embodiment of FIG. 1, in which lever 3 comprises an articulation pin 7 integral with said lever, adapted to move in a hole going through handle 1 and immobilized during extraction efforts successively in housing 9 for the first half of the extraction step and in housing 10 for the second part of cork extraction thus keeping end 11 of of the first notch from striking the part of the cork that has just been extracted in the first phase.

It is also possible, as shown in FIG. 2*a*, to make the hole in lever 3 and use a pin 7, provided with shoulders 7*a* and 7*b*, resting on the edges of the lever hole. Pin 7 is then preferably mounted firmly on handle 1.

FIG. 3 shows another variant of the corkscrew the extraction lever of which comprises two articulation positions. On the other hand, lever 12, articulated on pin 13, comprises only a single notch 14 that can occupy two extraction positions corresponding to 5 and 6 of the lever of FIG. 1 due to hole 15, consisting of a first straight part 16 ending on the handle side, and a second right angle part 17 whose end comprises a holding housing 18 immobilizing pin 13 during the second half of extraction. The first half of extraction is performed when articulation pin 13 is resting on end 19 of hole 16, notch 14 being able to rest on the rim of the bottle neck. Distance 20 between rest positions 18 and 19 of pin 13 corresponds to that of housing 9, 10 of FIG. 2; it also has the effect of separating the lever from the edge of the cork.

FIG. 4 shows a variant embodiment of a corkscrew, the extraction lever of which consists of two separate levers 21, 22, articulated like a cover on the same pin 4 integral with handle 1. Small lever 22 comprising notch 5 disappears inside the large lever during the second extraction. To keep small lever 22 from going completely through large lever 21, a clearance 25 is made in the large lever working with a bend of the small lever described in FIG. 4*a*.

FIG. 4 shows a support notch whose end 23, 24 is slightly bent to enlarge the surface for resting on the bottle neck.

By way of embodiment, FIGS. 5 and 6 show a cutting blade 26 fastened to handle 1 protected by retractable sliding cover 27 covering the blade when it is not being used. Cover 27 moves in the direction of arrow 28. Blade 26 is ground along a radius 29, a little larger than that of the bottles, to be easily placed on the neck.

FIG. 7 shows an embodiment of the cutting part made on active part 30 of the bottle opener. There again, grinding is done along a radius 31 or 32 and with a bevel as in FIG. 8.

FIG. 9 shows in section a variant of the bottle opener on which the cutting part is placed on the side opposite the active part on a bent piece 33.

FIG. 10 shows an added blade 34 fastened to the end opposite the active part of bottle opener 30.

We claim:

1. A corkscrew for removing a cork from the mouth of a bottle comprising a flat elongated handle having first and second ends, auger means positioned between said first and second ends and pivotally attached to said handle, and extraction lever means secured to said handle about pivot means located at one of said first or second ends, said extraction lever means comprising first and second levers, each secured at one end thereof to said handle at said pivot means, said first lever including a first notch and said second lever including a second notch, and said first and second notches being located at first and second unequal distances away from said pivot means, whereby after screwing said auger into said cork, upon positioning the notch least distant from said pivot means against said bottle mouth, said handle is pivoted about said pivot means causing a first partial extraction of said cork from said bottle mouth, with subsequent complete removal of said cork from said bottle mouth being facilitated by thereafter positioning the other notch most distant from said pivot means against said bottle mouth and pivoting said handle about said pivot means, causing a second total extraction of said cork, via said auger pivoting about said pivot means, out of said bottle mouth in a two-step removal operation.

2. The corkscrew according to claim 1, wherein said handle comprises, on a side opposite the auger, a cutting blade for cutting the protective cap of said cork, said blade being fastened rigidly to said handle, said handle including a cover having a position for protecting said blade when it is not in use, said cover being supported for sliding movement into and out of its protecting position.

3. The corkscrew of claim 1, wherein one of said first or second levers is configured to cover the other of said levers when said other of said levers is not being used.

4. The corkscrew of claim 1, wherein said pivot means comprises a pivot pin, and a slot means carried by said extraction lever means extending normal to the longitudinal extent of said extraction lever means, each end of said slot means including a recess directed toward said longitudinal extent and defining means for selectively positioning said first and second notches of said lever means adjacent said bottle mouth, whereby said lever means is articulated by said pivot means to first and second positions thereby facilitating said first and second extractions, respectively.

* * * * *